US009540198B2

(12) United States Patent
Yoshida

(10) Patent No.: US 9,540,198 B2
(45) Date of Patent: Jan. 10, 2017

(54) SHEET CONVEYING DEVICE AND IMAGE FORMING APPARATUS INCORPORATING THE SHEET CONVEYING DEVICE

(71) Applicant: Kohsuke Yoshida, Kanagawa (JP)

(72) Inventor: Kohsuke Yoshida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/001,947

(22) Filed: Jan. 20, 2016

(65) Prior Publication Data

US 2016/0221781 A1 Aug. 4, 2016

(30) Foreign Application Priority Data

Jan. 29, 2015 (JP) ..... 2015-015079

(51) Int. Cl.
*B65H 5/06* (2006.01)
*B65H 9/00* (2006.01)
*B65H 9/06* (2006.01)

(52) U.S. Cl.
CPC ..... *B65H 9/006* (2013.01); *B65H 5/062* (2013.01); *B65H 9/00* (2013.01); *B65H 9/004* (2013.01); *B65H 9/06* (2013.01)

(58) Field of Classification Search
CPC ..... B65H 5/062; B65H 9/00; B65H 9/004; B65H 9/006; B65H 9/06
USPC ..... 271/242, 245, 246
See application file for complete search history.

(56) References Cited

U.S. PATENT DOCUMENTS 4,844,443 A * 7/1989 Trafton ..... B65H 9/06 271/245
5,233,400 A * 8/1993 Cahill ..... B65H 9/06 271/245
6,011,948 A * 1/2000 Amano ..... B65H 9/06 271/245
8,317,192 B2 * 11/2012 Karikusa ..... B65H 7/02 271/243
8,348,266 B2 * 1/2013 Deno ..... B65H 5/38 271/245

(Continued)

FOREIGN PATENT DOCUMENTS

JP 2000-095394 4/2000
JP 2006-312543 11/2006

(Continued)

*Primary Examiner* — David H Bollinger
(74) *Attorney, Agent, or Firm* — Harness, Dickey & Pierce, P.L.C.

(57) ABSTRACT

A sheet conveying device, which is incorporated in an image forming apparatus, includes a pair of sheet holding rollers and a regulator. The pair of sheet holding rollers disposed along a sheet conveying path rotates and conveys the recording medium while holding a recording medium in a nip region thereof. The pair of sheet holding rollers includes a stopper that rotates with the pair of sheet holding rollers between a closing position at which the sheet conveying path is closed and an opening position at which the sheet conveying path is open. The regulator is movably disposed between a contact position and a retracted position with respect to the pair of sheet holding rollers. The pair of sheet holding rollers corrects a positional shift of the recording medium in the sheet conveying direction with the stopper at the closing position, and further conveys the recording medium after correction.

10 Claims, 3 Drawing Sheets

(56) References Cited

U.S. PATENT DOCUMENTS

| | | | | |
|---|---|---|---|---|
| 2004/0028438 | A1* | 2/2004 | Shin | B65H 5/38 399/388 |
| 2007/0147919 | A1* | 6/2007 | Lim | B41J 11/006 399/388 |
| 2008/0143045 | A1* | 6/2008 | Yu | B65H 9/004 271/245 |
| 2008/0310906 | A1* | 12/2008 | Yang | B41J 13/03 400/630 |
| 2009/0102117 | A1* | 4/2009 | Yu | B65H 9/006 271/226 |
| 2009/0189338 | A1* | 7/2009 | Yu | B65H 9/004 271/229 |
| 2010/0301546 | A1* | 12/2010 | Ninomiya | B65H 5/062 271/253 |
| 2012/0181744 | A1* | 7/2012 | Suzuki | B65H 5/062 271/243 |
| 2013/0161901 | A1* | 6/2013 | Uchida | G03G 15/6567 271/245 |
| 2013/0241141 | A1* | 9/2013 | Karikusa | B65H 9/00 271/227 |
| 2015/0071692 | A1 | 3/2015 | Maruta et al. | |

FOREIGN PATENT DOCUMENTS

| | | |
|---|---|---|
| JP | 2010-215378 | 9/2010 |
| JP | 2012-254847 | 12/2012 |
| JP | 2014-058369 | 4/2014 |

* cited by examiner

SHEET CONVEYING DEVICE AND IMAGE FORMING APPARATUS INCORPORATING THE SHEET CONVEYING DEVICE

CROSS-REFERENCE TO RELATED APPLICATIONS

This patent application is based on and claims priority pursuant to 35 U.S.C. §119(a) to Japanese Patent Application No. 2015-015079, filed on Jan. 29, 2015, in the Japan Patent Office, the entire disclosure of which is hereby incorporated by reference herein.

BACKGROUND

1. Technical Field

This disclosure relates to a sheet conveying device to correct positional shifts of a recording medium while the recording medium is traveling in a sheet conveying path, and an image forming apparatus including the sheet conveying device.

2. Related Art

Various types of electrophotographic image forming apparatuses include copiers, printers, facsimile machines, or multifunction machines having two or more of copying, printing, scanning, facsimile, plotter, and other capabilities. Such image forming apparatuses usually include a sheet holding roller that has a stopper (a contact member) attached thereto. The stopper rotates with the sheet holding roller to correct a positional shift and a skew with respect to a sheet conveying direction of a recording medium in a sheet conveying path.

Specifically, in such image forming apparatuses, for example, the sheet holding roller includes two rollers, one of which mounts the stopper thereon to rotate together with the stopper. As the sheet holding roller rotates, the stopper closes the sheet conveying path. With this action, a leading edge of the recording medium that travels in the sheet conveying path contacts the stopper. Consequently, a positional shift in the sheet conveying direction of the recording medium is corrected, which is for convenience referred to as a "positional registration correction". At the same time, the a positional direction to an oblique side in the sheet conveying direction of the recording medium is corrected, which is for convenience referred to as a "skew correction". After completion of the positional registration correction and the skew correction, as the sheet holding roller rotates, the stopper opens the sheet conveying path, so that the recording medium further travels toward a downstream side of the sheet conveying path.

As described above, when the positional registration correction and the skew correction are performed, the recording medium contacts the stopper of the sheet holding roller. Impact or shock caused by the contact of the recording medium to the stopper vibrates the stopper in a rotational direction together with the sheet holding roller, and therefore it is likely that the degree of precision of the positional registration correction and the skew correction is reduced.

When the sheet holding roller is driven by gear drive transmission, the stopper easily vibrates in the rotational direction together with the sheet holding roller within a range not exceeding a backlash range.

SUMMARY

At least one aspect of this disclosure provides a sheet conveying device including a pair of sheet holding rollers and a regulator. The pair of sheet holding rollers has two rollers and is disposed along a sheet conveying path through which a recording medium is conveyed. The pair of sheet holding rollers rotates and conveys the recording medium while holding the recording medium in a nip region formed between the two rollers. The pair of sheet holding rollers mounts a stopper thereon at a position upstream from the nip region in a sheet conveying direction. The stopper rotates with the pair of sheet holding rollers between a closing position at which the sheet conveying path is closed and the recording medium stops before the nip region of the pair of sheet holding rollers and an opening position at which the sheet conveying path is open and the recording medium passes through the nip region of the pair of sheet holding rollers. The regulator is movably disposed between a contact position at which the regulator is in contact with the pair of sheet holding rollers and a retracted position at which the regulator is separated from the pair of sheet holding rollers. The pair of sheet holding rollers corrects a positional shift of the recording medium in the sheet conveying direction with the stopper located at the closing position, and further conveys the recording medium after correction.

Further, at least one aspect of this disclosure provides an image forming apparatus including the above-described sheet conveying device, and an image forming disposed downstream from the sheet conveying device in the sheet conveying direction.

DETAILED DESCRIPTION

Figure 1:
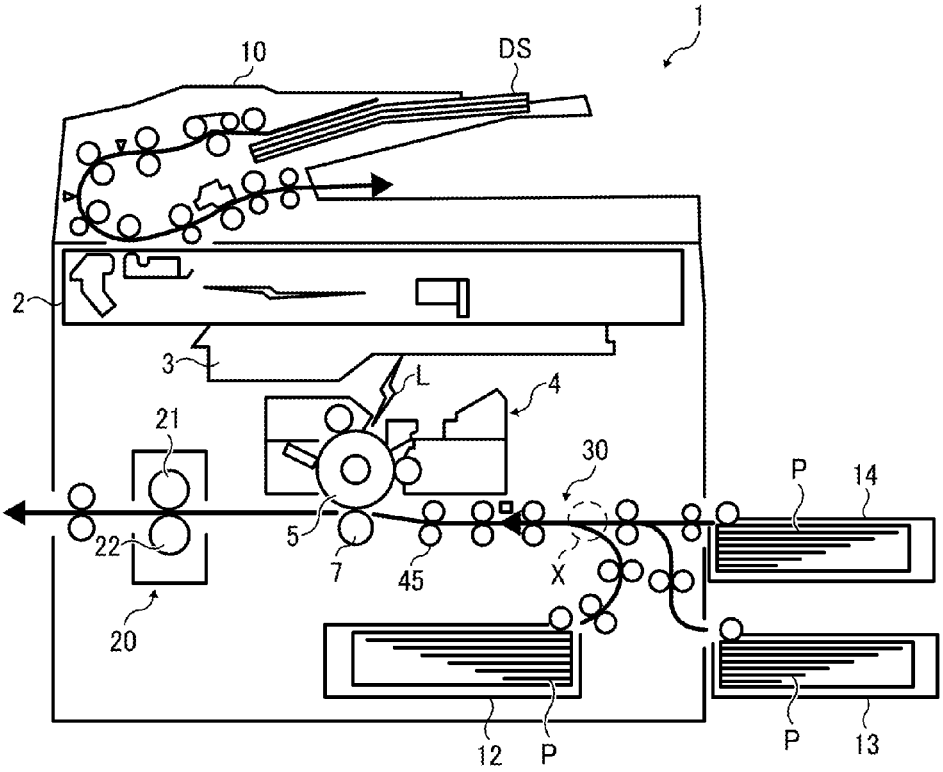
FIG. 1 is a diagram illustrating an overall structure of an image forming apparatus according to an example of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

A description is given of an overall configuration and operations of an image forming apparatus 1 according to an example of this disclosure, with reference to FIG. 1.

FIG. 1 is a diagram illustrating a schematic configuration of the image forming apparatus 1 according to an example of this disclosure.

It is to be noted that identical parts are given identical reference numerals and redundant descriptions are summarized or omitted accordingly.

The image forming apparatus 1 may be a copier, a facsimile machine, a printer, a multifunction peripheral or a multifunction printer (MFP) having at least one of copying, printing, scanning, facsimile, and plotter functions, or the like. According to the present example, the image forming apparatus 1 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

In FIG. 1, the image forming apparatus 1 includes a document reading unit 2, an exposure unit 3, an image forming device 4, a photoconductor drum 5, a transfer roller 7, a document conveying unit 10, a first sheet feeding unit 12, a second sheet feeding unit 13, a third sheet feeding unit 14, a fixing device 20, a sheet conveying device 30, and a first pair of sheet conveying rollers 45.

The document reading unit 2 optically reads image data of an original document DS.

The exposure unit 3 emits an exposure light L based on the image data read by the document reading unit 2 to irradiate the exposure light L on a surface of the photoconductor drum 5 that functions as an image bearer.

The image forming device 4 forms a toner image on the surface of the photoconductor drum 5. The photoconductor drum 5 that functions as an image bearer and the transfer roller 7 that functions as a transfer unit are included in the image forming device 4.

The transfer roller 7 is included in the image forming device 4 to transfer the toner image formed on the surface of the photoconductor drum 5 onto a recording medium P.

The document conveying unit 10 conveys the original document DS set on a document tray or loader to the document reading unit 2.

The first sheet feeding unit 12, the second sheet feeding unit 13, and the third sheet feeding unit 14 are sheet trays (sheet cassettes) each of which accommodates the recording medium (sheet) P such as a transfer sheet therein.

The fixing device 20 includes a fixing roller 21 and a pressure roller 22 to fix an unfixed image formed on the recording medium P to the recording medium P by application of heat and pressure.

The sheet conveying device 30 conveys the recording medium P to the sheet conveying path.

The first pair of sheet conveying rollers 45 functions as a pair of registration rollers to convey the recording medium P toward the transfer roller 7.

A description is given of regular image forming operations performed in the image forming apparatus 1 according to an example of this disclosure, with reference to FIG. 1.

The original document DS is fed from a document loading table provided to the document conveying unit 10 and conveyed by multiple pairs of sheet conveying rollers disposed in the document conveying unit 10 in a direction indicated by arrow in FIG. 1 over the document reading unit 2. At this time, the document reading unit 2 optically reads image data of the original document DS passing thereover. The image data optically scanned by the document reading unit 2 is converted to electrical signals. The converted electrical signals are transmitted to the exposure unit 3. Then, the exposure unit 3 emits exposure light (laser light beam) L based on the image data of the electrical signals toward the surface of the photoconductor drum 5 of the image forming device 4.

By contrast, the photoconductor drum 5 of the image forming device 4 rotates in a clockwise direction in FIG. 1. After a series of given image forming processes, e.g., a charging process, an exposing process, and a developing process, a toner image corresponding to the image data is formed on the surface of the photoconductor drum 5.

Thereafter, the toner image formed on the surface of the photoconductor drum 5 is transferred by the transfer roller 7, in a transfer nip region in the image forming device 4 where the transfer roller 7 and the photoconductor drum 5 contact to each other, onto the recording medium P conveyed by the first pair of sheet conveying rollers 45 that functions as a pair of registration rollers.

Figure 2:
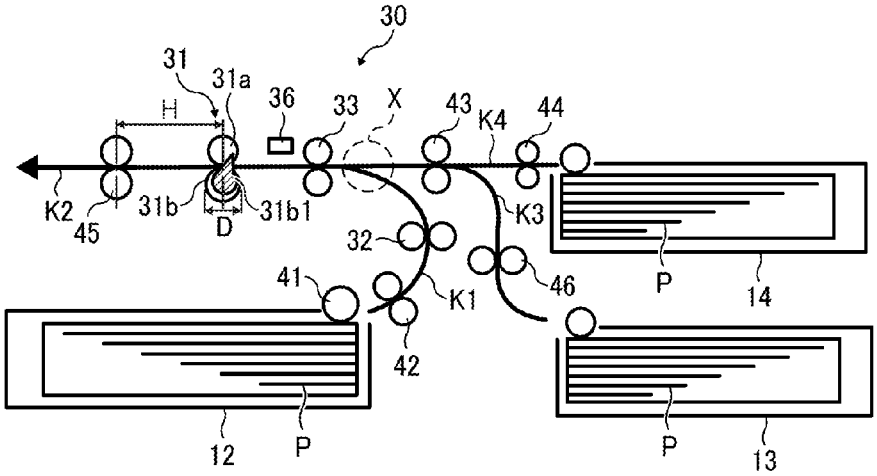
FIG. 2 is a diagram illustrating a sheet conveying device included in the image forming apparatus of FIG. 1.

Then, a description is given of movement of the recording medium P that is conveyed to the transfer roller 7, with reference to FIGS. 1 and 2.

As illustrated in FIGS. 1 and 2, one of the first sheet feeding unit 12, the second sheet feeding unit 13, and the third sheet feeding unit 14 of the image forming apparatus 1 is selected automatically or manually. It is to be noted that the first sheet feeding unit 12, the second sheet feeding unit 13, and the third sheet feeding unit 14 basically have an identical configuration to each other, except the second sheet feeding unit 13 and the third sheet feeding unit 14 disposed outside an apparatus body of the image forming apparatus 1. For example, when the first sheet feeding unit 12 of the image forming apparatus 1 is selected, an uppermost recording medium P accommodated in the first sheet feeding unit 12 is fed by a sheet feed roller 41 to a curved sheet conveying path K1 in which a first alignment support 52A is disposed.

The recording medium P travels in the curved sheet conveying path K1 toward a merging point X where the curved sheet conveying path K1 of the recording medium P fed from the first sheet feeding unit 12 and respective sheet conveying paths K3 and K4 of the recording medium P fed from the second sheet feeding unit 13 and the third sheet feeding unit 14 disposed outside an apparatus body of the image forming apparatus 1 merge.

After passing the merging point X, the uppermost recording medium P passes a straight sheet conveying path K2, and reaches the first pair of sheet conveying rollers (the pair of registration rollers) 45. The recording medium P that has arrived at the first pair of sheet conveying rollers 45 is then conveyed toward the transfer roller 7 in synchronization with movement of the toner image formed on the surface of the photoconductor drum 5 for positioning.

After completion of the transferring process, the recording medium P passes the transfer roller 7 and reaches the fixing device 20 via the sheet conveying path.

In the fixing device 20, the recording medium P is conveyed between the fixing roller 21 and the pressure roller 22, so that the toner image is fixed to the recording medium P by heat applied by the fixing roller 21 and pressure applied by the fixing roller 21 and the pressure roller 22. The recording medium P with the toner image fixed thereto passes a nip region formed between the fixing roller 21 and the pressure roller 22, and then exits from the apparatus body of the image forming apparatus 1.

Accordingly, a series of image forming processes is completed.

As illustrated in FIG. 2, the image forming apparatus 1 according to the present example of this disclosure feeds the recording medium P from any selected one of the first sheet feeding unit 12, the second sheet feeding unit 13, and the third sheet feeding unit 14 toward the transfer roller 7.

Specifically, the first sheet feeding unit 12 is disposed inside and at a lower portion of the apparatus body of the image forming apparatus 1.

A curved sheet conveying path K1 that functions as a sheet conveying path is a curved path extending from the first sheet feeding unit 12 through the merging point X. The curved sheet conveying path K1 is defined by curved sheet conveying guide plates disposed facing each other so as to hold both front and back surfaces of the recording medium P therebetween. A third pair of sheet conveying rollers 42 and a fourth pair of sheet conveying rollers 32 are disposed in the curved sheet conveying path K1 along the sheet conveying direction.

Each of the third pair of sheet conveying rollers 42 and the fourth pair of sheet conveying rollers 32 is a pair of rollers including a driving roller and a driven roller. The driving roller is driven and rotated by a driving mechanism provided to the image forming apparatus 1 and the driven roller rotates with the driving roller by a frictional resistance to rotation of the driving roller. Each of the third pair of sheet conveying rollers 42 and the fourth pair of sheet conveying rollers 32 conveys the recording medium P while holding the recording medium between the driving roller and the driven roller.

The second sheet feeding unit 13 and the third sheet feeding unit 14 are disposed outside of one side of the apparatus body of the image forming apparatus 1.

The sheet conveying path extending from the second sheet feeding unit 13 through the merging point X includes the curved sheet conveying path K3 and a straight conveying path and is provided with a fifth pair of sheet conveying rollers 43 and a sixth pair of sheet conveying rollers 46.

The sheet conveying path extending from the third sheet feeding unit 14 through the merging point X includes the straight sheet conveying path K4 and is provided with the fifth pair of sheet conveying rollers 43 and a seventh pair of sheet conveying rollers 44.

The curved sheet conveying path K3 and the straight sheet conveying path K4 are defined by the curved sheet conveying guide plates and the straight sheet conveying guide plates, respectively.

Each of the fourth pair of sheet conveying rollers 32, the fifth pair of sheet conveying rollers 43, and the seventh pair of sheet conveying rollers 44 is a pair of rollers including a driving roller and a driven roller. Each of the fourth pair of sheet conveying rollers 32, the fifth pair of sheet conveying rollers 43, the sixth pair of sheet conveying rollers 46, and the seventh pair of sheet conveying rollers 44 conveys the recording medium P while holding the recording medium between the driving roller and the driven roller.

The fifth pair of sheet conveying rollers 43 is disposed at a position in the vicinity of the curved sheet conveying path K3 in a straight sheet conveying path upstream from the merging point X. The straight sheet conveying path is a path that extends from a merging point of the second sheet feeding unit 13 and the third sheet feeding unit 14 and that is commonly used by the second sheet feeding unit 13 and the third sheet feeding unit 14.

Further, the straight sheet conveying path K2 is a substantially linear path extending along the sheet conveying direction of the recording medium P from the merging point X, where the curved sheet conveying path K1 of the first sheet feeding unit 12 and the straight sheet conveying path of the second sheet feeding unit 13 and the third sheet feeding unit 14 merge, to a first pair of the conveying rollers (a pair of registration rollers) 45. The straight sheet conveying path K2 is defined by linear conveying guide plates disposed facing each other so as to hold both the front and back surfaces of the recording medium P therebetween. The third pair of sheet conveying rollers 42 and the fourth pair of sheet conveying rollers 32 are disposed in the curved sheet conveying path K1 along the sheet conveying direction. The second pair of sheet conveying rollers 33 that functions as a feed roller pair, the sheet detection sensor 36 that functions as a detector, the pair of sheet holding rollers 31 that functions as a pair of positional registration and skew correction rollers, and the first pair of sheet conveying rollers 45 are disposed along the sheet conveying direction. Each of the second pair of sheet conveying rollers 33, the pair of sheet holding rollers 31, and the first pair of sheet conveying rollers 45 is a pair of rollers including a driving roller and a driven roller. Each of the second pair of sheet conveying rollers 33, the pair of sheet holding rollers 31, and the first pair of sheet conveying rollers 45 conveys the recording medium P while holding the recording medium between the driving roller and the driven roller. The pair of sheet holding rollers 31 disposed in the straight sheet conveying path K2 also functions as a matching unit to perform the positional registration and skew correction.

Next, a description is given of the sheet conveying device 30 according to an example of this disclosure, with reference to FIGS. 2 through 5. Specifically, a configuration, functions, and operations of the sheet conveying device 30 performed in the various sheet conveying paths from the first sheet feeding unit 12 to the first pair of sheet conveying rollers 45 are described.

Figure 3:
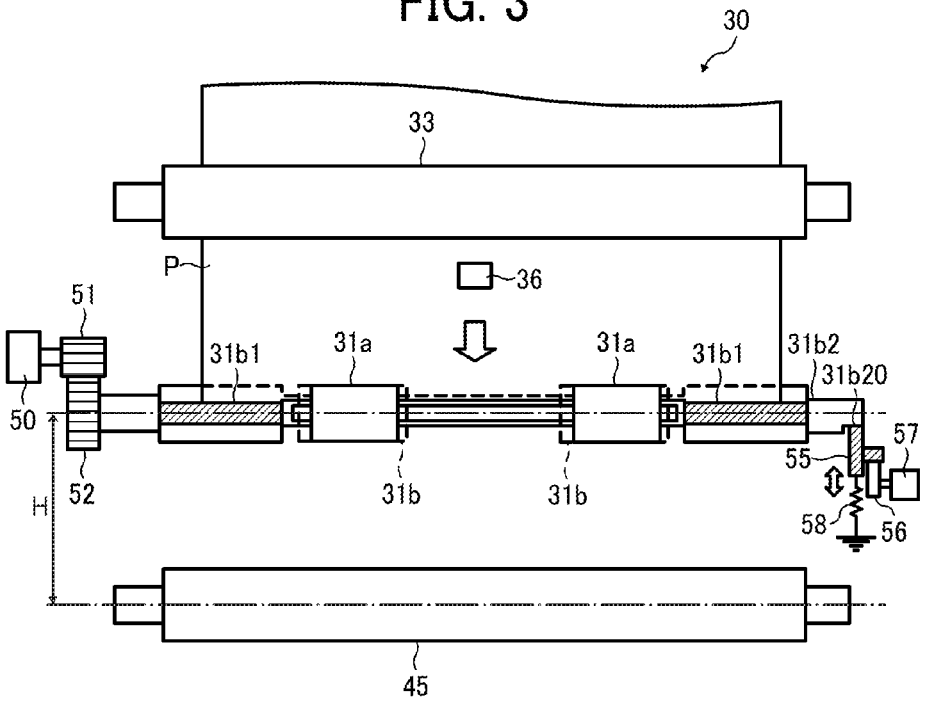
FIG. 3 is a top view illustrating part of the sheet conveying device of FIG. 2.

As illustrated in FIGS. 2 and 3, various units are disposed in the sheet conveying device 30 along the sheet conveying path of the recording medium P, which is a path indicated with a thick and solid line of FIG. 2. Specifically, the curved sheet conveying path K1 is defined by the third pair of sheet conveying rollers 42 and the fourth pair of sheet conveying rollers 32, and the straight sheet conveying path K2 is defined by the second pair of sheet conveying rollers 33, the sheet detection sensor 36 that functions as a detector, the pair of sheet holding rollers 31 that functions as a positional registration and skew correction rollers, and the first pair of sheet conveying rollers 45 that functions as a pair of registration rollers.

The pair of sheet holding rollers 31 is a roller pair that has rollers divided in the width direction and includes a driven roller 31*a* and a driving roller 31*b* that includes a stopper 31*b*1 that functions as a contact member. The pair of sheet holding rollers 31 is driven by a separating and attaching mechanism, so that the two rollers thereof contact to and separate from each other. Specifically, the pair of sheet holding rollers 31 separatably provided to move between a holding position to hold the recording medium therebetween and a releasing position to release the recording medium P therefrom. In addition, as the pair of sheet holding rollers 31 rotates, the recording medium P is conveyed.

When the recording medium P conveyed by the pair of sheet holding rollers 31 is held between the driving roller and the driven roller of the first pair of sheet conveying rollers 45, the two rollers of the pair of sheet holding rollers 31 are separated from each other so as not to hold the recording medium.

Further, the stopper 31*b*1 includes a resin material or a metallic material and rotates together with (the driving roller 31*b* of) the pair of sheet holding rollers 31.

Figure 5A:
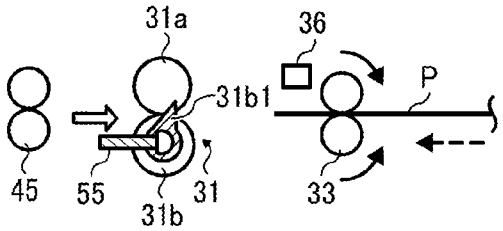
FIG. 5A is a diagram illustrating a sheet conveying operation performed by the sheet conveying device.
Figure 5B:
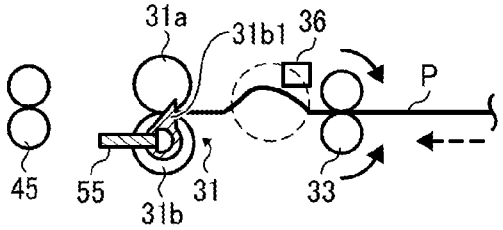
FIG. 5B is a diagram illustrating a subsequent sheet conveying operation performed by the sheet conveying device after FIG. 5A.

With this configuration, the sheet conveying path is switched between a closing position and an opening position at a position upstream from the nip region of the pair of sheet holding rollers 31 as the stopper 31*b*1 rotates. The closing position is a position in which the sheet conveying path is closed or blocked, so that the recording medium cannot enter the nip region of the pair of sheet holding rollers 31. The opening position is a position in which the sheet conveying path is open and passable, so that the recording medium can pass through the nip region of the pair of sheet holding rollers 31. Specifically, the stopper 31*b*1 is mounted on (a shaft of) the driving roller 31*b*, so that the stopper 31*b*1 projects from (a part of) an outer circumferential surface of a roller part of the driving roller 31*b*. The driving roller 31*b* is one of the two rollers of the pair of sheet holding rollers 31. The roller part of the driving roller 31*b* is provided at both ends in the width direction or axial direction of the driving roller 31*b*. As the driving roller 31*b* rotates, the stopper 31*b*1 comes to the closing position to close the sheet conveying path, as illustrated in FIGS. 5A and 5B. Accordingly, the leading edge of the recording medium P contacts the stopper 31*b*1 so that the positional registration and skew of the recording medium P can be corrected. That is, the pair of sheet holding rollers 31 functions as a correcting member to perform positional shift and skew of the recording medium P.

The pair of sheet holding rollers 31 rotates by a driving force exerted by gear drive transmission. Specifically, as illustrated in FIG. 3, the driving roller 31*b* includes a shaft 31*b*2. A driven gear 52 is mounted on one end side along a width of the shaft 31*b*2 of the driving roller 31*b*. Here, the width direction is a direction perpendicular to a drawing sheet of FIG. 2 and a left-and-right direction of FIG. 3. The driven gear 52 meshes with a driving gear 51 of a driving motor 50. With this configuration, a rotational driving force that is generated by the driving motor 50 is transmitted to the driving roller 31*b* via the driving gear 51 and the driven gear 52. As the driving roller 31*b* driven by the rotational driving force rotates in a counterclockwise direction of FIG. 2, the driven roller 31*a* rotates with the driving roller 31*b* in a clockwise direction of FIG. 2.

Further, an encoder is mounted on the shaft of the driving roller 31*b* to detect a posture of the driving roller 31*b* (the position of the stopper 31*b*1) in the rotational direction.

The second pair of sheet conveying rollers 33 (the feed roller) is disposed at a position upstream from the pair of sheet holding rollers 31 in the sheet conveying direction and between the fourth pair of sheet conveying rollers 32 and the pair of sheet holding rollers 31. The second pair of sheet conveying rollers 33 rotates while holding the recording medium P between the driving roller and the driven roller thereof, so that the recording medium P is conveyed in the sheet conveying path. The time of conveyance (driving) of the recording medium P is controlled to form a deflection of the recording medium P between the second pair of sheet conveying rollers 33 and the stopper 31*b*1 when the second pair of sheet conveying rollers 33 holds and conveys the recording medium P to cause the leading edge of the recording medium P to the stopper 31*b*1 of the pair of sheet holding rollers 31. The deflection of the recording medium P is indicated in FIG. 5B in an area with a dotted line.

The first pair of sheet conveying rollers (the pair of registration rollers) 45 is a pair of rollers disposed downstream from the pair of sheet holding rollers 31 in the sheet conveying direction. By rotating the first pair of sheet conveying rollers 45 while holding the recording medium P, the recording medium is conveyed to a further downward side in the sheet conveying direction.

After the pair of sheet holding rollers 31 has corrected the positional shift and skew of the recording medium P, the recording medium P is conveyed to the first pair of sheet conveying rollers 45. When a photosensor that is disposed between the first pair of sheet conveying rollers 45 and the image forming device 4 detects that the recording medium P is held by the first pair of sheet conveying rollers 45, the conveyance of the recording medium P is temporarily stopped. After a given period of time, the first pair of sheet conveying rollers 45 starts driving and rotating again so as to synchronize with movement of an image formed on the photoconductor drum 5. Accordingly, a timing of conveyance of the recording medium P to be conveyed toward the image forming device 4 is adjusted.

In the present example, the stopper 31*b*1 provided to the pair of sheet holding rollers 31 moves from the closing position to the opening position, and to the closing position again while the pair of sheet holding rollers 31, i.e., the driving roller 31*b* of the pair of sheet holding rollers 31 rotates by one cycle. In other words, the stopper 31*b*1 projects from a portion in a circumferential direction on an outer circumferential surface of the driving roller 31*b*.

Further, as illustrated in FIG. 2, the distance H in the sheet conveying path from the nip region, which is formed between and pressed by the driving roller 31*b* and the driven roller 31*a* of the pair of sheet holding rollers 31 to the nip region formed between and pressed by two rollers of the first pair of sheet conveying rollers 45 is set shorter than a distance of one cycle of rotation of the pair of sheet holding rollers 31, more specifically, the driving roller 31*b* to convey the recording medium P. That is, the distance H from the nip region of the pair of sheet holding rollers 31 to the nip region of the first pair of sheet conveying rollers 45 is set shorter than a distance in the rotational direction of the stopper 31*b*1 moving from the closing position to close the sheet conveying path to the opening position to open the sheet conveying path and further to the closing position again along with rotation of the pair of sheet holding rollers 31.

Specifically, an equation of $H<\pi D$ is satisfied, where "D" represents an outside diameter of the driving roller 31*b*. It is to be noted that the distance H is drawn relatively longer than an actual setting of the sheet conveying device 30 in FIGS. 2 through 5 for better visibility.

With this configuration, after the positional shift and skew corrections with respect to the sheet conveying direction of the recording medium P are conducted with the leading edge of the recording medium P in contact with the stopper 31*b*1, the pair of sheet holding rollers 31 is rotated to convey the recording medium P toward the nip region of the first pair of sheet conveying rollers 45 while holding the recording medium P between the driving roller 31*b* and the driven roller 31*a*. At this time, the configuration of the sheet conveying device 30 according to the present example can prevent the stopper 31*b*1 from contacting a body of the recording medium P while being held by the pair of sheet holding rollers 31 and interfering conveyance of the recording medium P.

The sheet detection sensor 36 that functions as a detector is disposed on an upstream side of the sheet conveying path from the pair of sheet holding rollers 31 and on a downstream side of the sheet conveying path from the second pair of sheet conveying rollers 33 in the sheet conveying direction. The sheet detection sensor 36 is a reflection sensor including a light emitting element such as one or more sets of light emitting diodes (LEDs) and a light receiving element such as one or more photodiodes and optically detects the recording medium P. Specifically, the sheet detection sensor 36 functioning as a detector detects the timing of passage of the leading edge of the recording medium P in the sheet conveying path in the sheet conveying device 30. Then, rotation of the pair of sheet holding rollers 31 (the posture in the rotational direction of the pair of sheet holding rollers 31) is controlled based on the results detected by the sheet detection sensor 36.

As illustrated in FIGS. 3 through 5, the sheet conveying device 30 in the present example includes a regulating member 55 that functions as a regulator to cause the stopper 31*b*1 not to rotate with the pair of sheet holding rollers 31, more specifically, with the driving roller 31*b* of the pair of sheet holding rollers 31.

The regulating member 55 is movably disposed between a contact position and a retracted position to restrict rotation of the stopper 31*b*1 to prevent the stopper 31*b*1 from rotating with the pair of sheet holding rollers 31. The contact position is where the regulating member 55 contacts the pair of sheet holding rollers 31, more specifically, the shaft 31*b*2 of the driving roller 31*b* of the pair of sheet holding rollers 31, as illustrated in FIGS. 3, 4A, 5A, and 5B. By contrast, the retracted position is where the regulating member 55 does not contact, that is, is separated from the pair of sheet holding rollers 31, to be more specific, the shaft 31*b*2 of the driving roller 31*b* of the pair of sheet holding rollers 31, as illustrated in FIGS. 4B, 5C, and 5D.

Figure 4A:
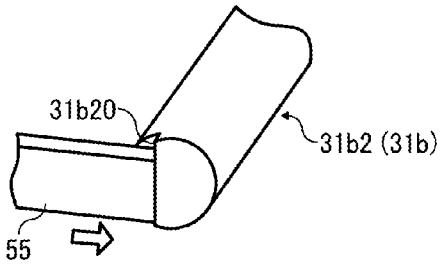
FIG. 4A is a perspective view illustrating a regulating member located at a contact position where the regulating member is in contact with a pair of sheet holding rollers.
Figure 4B:
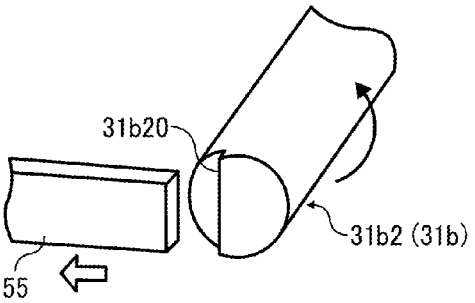
FIG. 4B is a perspective view illustrating the regulating member located at a retracted position at which the regulating member is separated from the pair of sheet holding rollers.
Figure 5C:
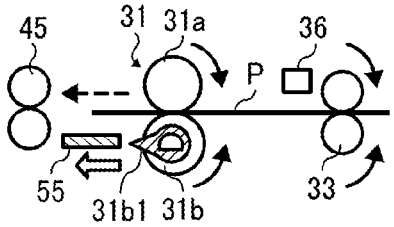
FIG. 5C is a diagram illustrating another subsequent sheet conveying operation performed by the sheet conveying device after FIG. 5B.
Figure 5D:
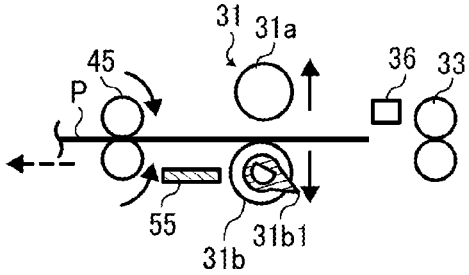
FIG. 5D is a diagram illustrating yet another subsequent sheet conveying operation performed by the sheet conveying device after FIG. 5C.

Specifically, the regulating member 55 is a substantially rectangular parallelepiped to perform a surface contact with a cut face partially formed on the shaft 31*b*2 of one of the pair of sheet holding rollers 31, i.e., the driving roller 31*b* in the present example, at the contact position, as illustrated in FIG. 4A. In the present example, the shaft 31*b*2 of the driving roller 31*b* has a D-cut face 31*b*20. However, the shape of the cut face is not limited thereto and a cut face having any face shape other than the D-cut face is also applicable to this disclosure.

The regulating member 55 is movably supported in directions indicated by arrow illustrated in FIG. 3 along a guide formed on a casing of the sheet conveying device 30, e.g., the apparatus body of the image forming apparatus 1.

Further, a cam mechanism is provided to the image forming apparatus 1 to function as a moving mechanism to move the regulating member 55. The cam mechanism is constructed by a cam 56, a cam motor 57, and a tension spring 58, as illustrated in FIG. 3.

The cam 56 is mounted on a motor shaft of the cam motor 57. A cam surface of the cam 56 contacts the regulating member 55.

The tension spring 58 has one end side that is connected to the regulating member 55 and an opposed end side that is connected to the casing of the sheet conveying device 30, e.g., the apparatus body of the image forming apparatus 1.

With this configuration, in a state in which a top dead center of the cam 56 contacts the regulating member 55, the cam 56 presses the regulating member 55 upwardly in FIG. 3 against a spring force exerted by the tension spring 58, so that the regulating member 55 becomes in contact with the driving roller 31*b*. Consequently, the stopper 31*b*1 is restricted so as not to rotate with the pair of sheet holding rollers 31, as illustrated in FIGS. 3, 4A, 5A, and 5B.

By contrast, in a state in which any portion of the cam 56 other than the top dead center, e.g., a bottom dead center, contacts the regulating member 55, the spring force exerted by the tension spring 58 presses the regulating member 55 downwardly in FIG. 3, so that the regulating member 55 separates or retracts from the driving roller 31*b*. Consequently, the stopper 31*b*1 is released from the regulation and can rotate with the pair of sheet holding rollers 31, as illustrated in FIGS. 4B, 5C, and 5D.

As described above, in the sheet conveying device 30 that is provided with the regulating member 55, as the recording medium P travels in the sheet conveying path, the pair of sheet holding rollers 31 rotates such that the stopper 31*b*1 closes the sheet conveying path and the regulating member 55 moves from the retracted position as illustrated in FIG. 4B to the contact position as illustrated in FIG. 4A. In this state, the leading edge of the recording medium P contacts the stopper 31*b*1. By so doing, the positional shift of the recording medium P in the sheet conveying direction and the skew of the recording medium P to the oblique side in the sheet conveying direction are corrected. Then, the regulating member 55 moves from the contact position as illustrated in FIG. 4A to the retracted position as illustrated in FIG. 4B and the pair of sheet holding rollers 31 rotates such that the stopper 31*b*1 opens the sheet conveying path, so that the pair of sheet holding rollers 31 rotates and conveys the recording medium P.

Specifically, when the recording medium P contacts the stopper 31*b*1 for correction of the positional shift and skew of the recording medium P, the regulating member 55 contacts the cut face (i.e., the D-cut face 31*b*20 in the present example) of the shaft 31*b*2 of the driving roller 31*b*, and therefore the driving roller 31*b*, more specifically, the stopper 31*b*1 of the driving roller 31*b* is restricted so as not to vibrate and rotate in the rotational direction thereof. By contrast, when the pair of sheet holding rollers 31 rotates at any other timing, the regulating member 55 is released and separated from the shaft 31*b*2, more specifically, the D-cut face 31*b*20 of the shaft 31*b*2.

Thus, the regulating member 55 restricts rotation of the driving roller 31*b* and the stopper 31*b*1. Therefore, even if any shock or impact occurs due to contact of the leading edge of the recording medium P to the stopper 31*b*1 of the pair of sheet holding rollers 31 when the positional registration and skew corrections are conducted to the recording medium P, the stopper 31*b*1 is prevented from vibrating to rotate in the rotational direction together with the pair of sheet holding rollers 31, more specifically, with the driving roller 31*b*. As a result, the configuration of the sheet conveying device 30 according to the present example can prevent a reduction in the degree of precision in correction of the positional shift and skew of the recording medium P.

In the sheet conveying device 30 according to the present example of this disclosure, the pair of sheet holding rollers 31 rotates by gear drive transmission and the stopper 31*b*1 easily vibrates in the rotational direction together with the driving roller 31*b* within a range not exceeding a backlash range of the driving gear 51 and the driven gear 52. Accordingly, a greater effect can be generated when employing the sheet conveying device 30 according to the present example of this disclosure to the image forming apparatus 1.

Further, in a case in which the recording medium P is a thick paper or a sheet having a thickness and rigidity greater than a plain paper, when the recording medium P travels the sheet conveying path in the sheet conveying device 30, a shock or impact generated when the recording medium P contacts the stopper 31*b*1 becomes greater. Therefore, a greater effect can be generated when employing the sheet conveying device 30 according to the present example of this disclosure to the image forming apparatus 1.

As described above, the sheet conveying device 30 according to the present example of this disclosure includes the regulating member 55 to restrict rotation of the stopper 31*b*1 (of the pair of sheet holding rollers 31) by contacting the driving roller 31*b* of the pair of sheet holding rollers 31. However, it is to be noted that the configuration of the sheet conveying device 30 is not limited thereto and a configuration in which the regulating member 55 restricts rotation of the stopper 31*b*1 (of the pair of sheet holding rollers 31) by contacting the stopper 31*b*1 can also be applied to this disclosure.

Further, in the sheet conveying device 30 according to the present example of this disclosure, the regulating member 55 to restrict rotation of the stopper 31*b*1 (of the pair of sheet holding rollers 31) by contacting the surface of the D-cut face 31*b*20 of the shaft 31*b*2 of the driving roller 31*b*. However, it is to be noted that the configuration of the regulating member to restrict rotation of the stopper 31*b*1 of the pair of sheet holding rollers 31 and a member receiving the regulating member is not limited thereto, and any other configuration can be applied to this disclosure as long as the regulating member can restrict rotation of the stopper 31*b*1 reliably.

Further, in the sheet conveying device 30 according to the present example of this disclosure, the cam mechanism including the cam 56, the cam motor 57, and the tension spring 58, is provided as a moving mechanism to move the regulating member 55 between the contact position and the retracted position. However, it is to be noted that the configuration of the cam mechanism is not limited thereto. For example, a moving mechanism that includes a solenoid can also be applied to this disclosure.

Further, in the present example, the regulating member 55 may be a member that can absorb vibration generated to the stopper 31*b*1 when the leading edge of the recording medium P contacts the stopper 31*b*1 when the regulating member 55 is at the contact position. For example, the entire regulating member 55 can include a shock absorbing material can be provided to the entire regulating member 55 or to a surface of the regulating member 55 contacting the D-cut face 31*b*20 of the driving roller 31*b*. Accordingly, any configuration of the regulating member described above can exhibit the above-described effects of this disclosure more reliably.

Now, a detailed description is given of operations of the sheet conveying device 30 having the above-described configuration, with reference to FIGS. 5A through 5D.

First, the recording medium P fed from the first sheet feeding unit 12 is conveyed by the third pair of sheet conveying rollers 42 and the fourth pair of sheet conveying rollers 32 while being held between the two rollers of the third pair of sheet conveying rollers 42 and the two rollers of the fourth pair of sheet conveying rollers 32. Then, as illustrated in FIG. 5A, the recording medium P is further conveyed by the second pair of sheet conveying rollers 33 toward the pair of sheet holding rollers 31 while being held between the two rollers of the second pair of sheet conveying rollers 33 in the sheet conveying direction, which is a direction indicated by a dotted arrow in FIG. 5A. Then, after detecting the leading edge of the recording medium P by the sheet detection sensor 36, the pair of sheet holding rollers 31 stops rotation with the posture in the rotational direction of the recording medium P fixed, as illustrated in FIG. 5A, so that the stopper 31*b*1 moves to the closing position in the sheet conveying path so as to meet the timing in which at least the leading edge of the recording medium P reaches the pair of sheet holding rollers 31. Further, the regulating member 55 moves to the contact position contacting the D-cut face 31*b*20 of the driving roller 31*b*, as illustrated in FIG. 5A.

Then, as illustrated in FIG. 5B, the recording medium P stops upon contact with the stopper 31*b*1. At this time, due to an overrun of the second pair of sheet conveying rollers 33, a given deflection is produced as a buffer illustrated by a dotted circle in FIG. 5B. The deflection amount of the recording medium P is adjusted according to the time of conveyance of the recording medium P from when the leading edge of the recording medium P is detected by the sheet detection sensor 36, in other words, the time in which the second pair of sheet conveying rollers 33 is driven and rotated.

Thus, the positional shift of the recording medium P in the sheet conveying direction is corrected. That is, the pair of sheet holding rollers 31 is driven to rotate with the positional shift of the recording medium P in the sheet conveying direction corrected, so that the recording medium P is conveyed toward the first pair of sheet conveying rollers 45.

Further, the contact of the leading edge of the recording medium P to the stopper 31*b*1 also corrects skew of the recording medium Pin the sheet conveying direction. That is, even if the recording medium P is conveyed with the posture tilted (skewed) to the oblique side in the sheet conveying direction, when one end of the leading edge of the recording medium P contacts the stopper 31*b*1, the other end of the leading edge of the recording medium P eventually contacts the stopper 31*b*1, centering the one end of the leading edge. Consequently, the skew of the recording medium P is corrected.

Then, when the positional shift and skew of the recording medium P are corrected, the regulating member 55 contacts the driving shaft 31*b*2 of the driving roller 31*b*. By so doing, the stopper 31*b*1 is prevented from vibrating to rotate together with the driving roller 31*b* in the rotational direction, and therefore the degree of precision in correction of the positional shift and skew of the recording medium P is enhanced.

Then, as illustrated in FIG. 5C, the recording medium P is held by the pair of sheet holding rollers 31 and the second pair of sheet conveying rollers 33 with the leading edge of the recording medium P remaining in contact with the stopper 31*b*1 after completion of the positional shift and skew corrections of the recording medium P. At this time, the regulating member 55 moves in a direction indicated by an arrow toward the retracted position, and the stopper 31*b*1 moves to the opening position along with rotation of the pair of sheet holding rollers 31, i.e., the driving roller 31*b*, in the direction indicated by arrow. Then, the pair of sheet holding rollers 31 and the second pair of sheet conveying rollers 33 start rotating in the direction indicated by arrow while holding the recording medium P, so that the recording medium P is conveyed to the first pair of sheet conveying rollers 45.

Then, as illustrated in FIG. 5D, the recording medium P after completion of correction of the positional shift and skew thereof temporarily stops while the leading edge of the recording medium P being held by the first pair of sheet conveying rollers 45. At this time, the pair of sheet holding rollers 31 that is holding the recording medium P opens the sheet conveying path and separates in a direction where the pair of sheet holding rollers 31 releases the recording medium P (in a direction indicted by a solid arrow).

Thereafter, in synchronization with movement of an image formed on the photoconductor drum 5, the first pair of sheet conveying rollers 45 starts rotating, and the recording medium P is conveyed toward the transfer roller 7. Accordingly, the image formed on the photoconductor drum 5 is transferred onto a desired position on the recording medium P.

Then, the separated pair of sheet holding rollers 31 moves to contact again after the trailing edge of the recording medium P is passed. The pair of sheet holding rollers 31 then rotates to the position where the stopper 31*b*1 closes the sheet conveying path (as illustrated in FIG. 5A).

As described above, in the present example, the pair of sheet holding rollers 31 rotates to cause the stopper 31*b*1 to close the sheet conveying path. Then, the leading edge of the recording medium P that is conveyed in the sheet conveying path contacts the stopper 31*b*1 with the regulating member 55 moving to the contact position with the pair of sheet holding rollers 31. By so doing, the positional shift of the recording medium in the sheet conveying direction and a skew of the recording medium to the oblique side in the sheet conveying direction are corrected. Thereafter, the pair of sheet holding rollers 31 rotates to cause the stopper 31*b*1 to open the sheet conveying path with the regulating member 55 located at the retracted position where the regulating member 55 is separated from the pair of sheet holding rollers 31. By so doing, the recording medium P is conveyed by the pair of sheet holding rollers 31.

According to this configuration, even if a shock is generated when the recording medium P contacts the stopper 31*b*1 of the pair of sheet holding rollers 31 at correction of the positional shift and skew of the recording medium P, rotation of the stopper 31*b*1 to vibrate with the pair of sheet holding rollers 31 in the rotational direction can be prevented.

As described above, the sheet conveying device 30 according to the present example of this disclosure is included in the image forming apparatus 1 that produces black-and-white images. However, it is to be noted that the configuration of the sheet conveying device 30 is not limited thereto and can be applied to an image forming apparatus that produces color images.

Further, the sheet conveying device 30 according to the present example of this disclosure is included in the image forming apparatus 1 that is an electrophotographic copier that forms toner images on recording media by electrophotography. However, it is to be noted that the configuration of the sheet conveying device 30 is not limited thereto and can be applied to any other image forming apparatus, for example, an inkjet type image forming apparatus, and an offset printing machine, as long as the sheet conveying device 30 performs the positional shift correction and the skew correction with respect to the recording medium P.

With these configurations, the image forming apparatus 1 and the sheet conveying device 30 can achieve the same effect as the configuration described in the above-described examples of this disclosure.

Further, in the present example, the sheet conveying device 30 that can be applied to this disclosure is disposed upstream from the first pair of sheet conveying rollers 45 in the sheet conveying direction. However, a configuration applicable to this disclosure is not limited thereto. Any other sheet conveying device disposed at a position different from the sheet conveying device 30 can be applied to this disclosure as long as the sheet conveying device corrects positional shift and skew of the recording medium P. For example, this disclosure can be applied to the pair of sheet holding rollers 31 if the pair of sheet holding rollers 31 functions as a pair of registration rollers such as the first pair of sheet conveying rollers 45.

Further, in the present example, the sheet conveying device 30 that can be applied to this disclosure is disposed upstream from the first pair of sheet conveying rollers 45 in the sheet conveying direction. However, a configuration applicable to this disclosure is not limited thereto. Any other sheet conveying device disposed at a position different from the sheet conveying device 30 can be applied to this disclosure as long as the sheet conveying device corrects positional shift and skew of the recording medium P. For example, this disclosure can be applied to the pair of sheet holding rollers 31 if the pair of sheet holding rollers 31 functions as a pair of registration rollers such as the first pair of sheet conveying rollers 45.

Further, in the present example, the sheet conveying device 30 that can be applied to this disclosure includes two sheet conveying paths meet and merge the merging point X. However, a configuration applicable to this disclosure is not limited thereto. For example, a sheet conveying device in which three or more sheet conveying paths meet and merge at the merging point X or a sheet conveying device having no merging point X but a single sheet conveying path can be applied to this disclosure.

Further, in the present example, the sheet conveying device 30 that can be applied to this disclosure includes three sheet feeding units, which are the first sheet feeding unit 12, the second sheet feeding unit 13, and the third sheet feeding unit 14. However, the number of the sheet feeding units is not limited thereto. Specifically, a sheet conveying device having one, two, four, and greater number of sheet feeding units can also be applied to the this disclosure.

With these configurations, the image forming apparatus 1 and the sheet conveying device 30 can achieve the same effect as the configuration described in the above-described examples of this disclosure.

Further, the sheet conveying device 30 in the present example includes eight (8) pairs of rollers 31 through 33 and 42 through 45. However, the number of pairs of rollers can be any other number. Even if the number of pairs of rollers is not 8, at least one of the pairs of rollers is the pair of sheet holding rollers 31. Alternatively, depending on the condition of conveyance of the recording medium P through the sheet conveying path, an operation different from the operation performed by the sheet conveying device 30 can be performed. For example, the operation is a separating operation of the second pair of sheet conveying rollers 33. Even if such the separating operation of the second pair of sheet conveying rollers 33 is performed, the same effect as the present example can be achieved.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet conveying device comprising:

a pair of sheet holding rollers having two rollers along a sheet conveying path through which a recording medium is conveyed, the pair of sheet holding rollers configured to rotate and convey the recording medium while holding the recording medium in a nip region between the two rollers;

a stopper on one roller of the pair of sheet holding rollers and at a position upstream from the nip region in a sheet conveying direction, the stopper configured to rotate with the pair of sheet holding rollers between a closing position and an opening position, the closing position being a position at which the sheet conveying path is closed and the recording medium stops before the nip region of the pair of sheet holding rollers, and the opening position being a position at which the sheet conveying path is open and the recording medium passes through the nip region of the pair of sheet holding rollers; and a regulator configured to move between a contact position and a retracted position, the contact position being a position at which the regulator is in contact with the one roller of the pair of sheet holding rollers, and the retracted position being a position at which the regulator is separated from the pair of sheet holding rollers, wherein the pair of sheet holding rollers is configured to correct a positional shift of the recording medium in the sheet conveying direction with the stopper at the closing position, and to further convey the recording medium after correction.

2. The sheet conveying device according to claim 1, wherein a leading edge of the recording medium contacts the stopper at the closing position in the sheet conveying path with the regulator at the contact position, the positional shift of the recording medium in the sheet conveying direction includes, a positional shift in which the recording medium is configured to shift along the sheet conveying direction, and a skew in which the recording medium is configured to tilt to an oblique side in the sheet conveying direction, and the recording medium passes through the nip region of the pair of sheet holding rollers after completion of correction of the positional shift with the stopper at the opening position in the sheet conveying path and the regulator at the retracted position.

3. The sheet conveying device according to claim 1, wherein the stopper is on one of the two rollers of the pair of sheet holding rollers, and the one of the two rollers of the pair of sheet holding rollers has a shaft with a partly cut face contacting the regulator contact.

4. The sheet conveying device according to claim 3, wherein the one of the two rollers of the pair of sheet holding rollers is a driving roller.

5. The sheet conveying device according to claim 3, wherein the cut face of the shaft is a D-cut face.

6. The sheet conveying device according to claim 1, further comprising:

a pair of sheet conveying rollers disposed downstream from the pair of sheet holding rollers in the sheet conveying direction, the pair of sheet conveying rollers configured to rotate while holding the recording medium and convey the recording medium wherein, when the pair of sheet conveying rollers holds the recording medium, the pair of sheet holding rollers is configured to separate from each other and release the recording medium.

7. The sheet conveying device according to claim 1, wherein the regulator is configured to absorb vibration generated to the stopper when the recording medium contacts the stopper at the contact position.

8. The sheet conveying device according to claim 1, wherein the pair of sheet holding rollers is configured to rotated by a driving force exerted by gear drive transmission.

9. An image forming apparatus comprising:

the sheet conveying device according to claim 1; and an image forming device downstream from the sheet conveying device in the sheet conveying direction.

10. The sheet conveying device according to claim 1, further comprising:

a detector configured to detect a leading edge of the recording medium prior to the leading edge entering the nip region.

* * * * *